US010156166B2

(12) United States Patent
Son et al.

(10) Patent No.: US 10,156,166 B2
(45) Date of Patent: Dec. 18, 2018

(54) 2-CYLINDER HYBRID ENGINE WITH OIL SUPPLY SYSTEM

(71) Applicant: HYUNDAI MOTOR COMPANY, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 145 days.

(21) Appl. No.: 15/336,135

(22) Filed: Oct. 27, 2016

(65) Prior Publication Data

US 2017/0167327 A1 Jun. 15, 2017

(30) Foreign Application Priority Data

Dec. 15, 2015 (KR) ..... 10-2015-0179486

(51) Int. Cl.

| | |
|---|---|
| ***F01L 1/34*** | (2006.01) |
| ***F01M 1/16*** | (2006.01) |
| ***F01M 9/10*** | (2006.01) |
| ***F02B 75/02*** | (2006.01) |
| ***F01L 31/00*** | (2006.01) |

(Continued)

(52) U.S. Cl.

CPC ..... *F01M 1/16* (2013.01); *F01L 1/356* (2013.01); *F01L 13/0015* (2013.01); *F01L 31/00* (2013.01); *F01M 9/10* (2013.01); *F01M 9/101* (2013.01); *F02B 75/02* (2013.01); *F01L 1/34* (2013.01); *F01L 2001/0473* (2013.01); *F01L 2001/0476* (2013.01); *F01L 2001/0537* (2013.01); *F01L 2810/03* (2013.01); *F01M 2001/064* (2013.01); *F02B 2075/025* (2013.01); *F02B 2075/1808* (2013.01)

(58) Field of Classification Search

CPC ..... F01M 1/16; F01M 9/10; F01M 9/101; F01M 2001/064; F02B 75/02; F02B 2075/025; F02B 2075/1808; F01L 31/00; F01L 1/356; F01L 13/0015; F01L 2810/03; F01L 1/34; F01L 2001/0476; F01L 2001/053; F01L 2001/0473; F01L 2001/0537

See application file for complete search history.

(56) References Cited

U.S. PATENT DOCUMENTS 5,829,401 A * 11/1998 Masuda ..... F01M 3/02 123/179.25
8,042,509 B2 * 10/2011 Shoji ..... F01L 1/053 123/193.5

FOREIGN PATENT DOCUMENTS

JP 2009-236010 A 10/2009
KR 10-2013-0063819 A 9/2013

* cited by examiner

*Primary Examiner* — Zelalem Eshete
(74) *Attorney, Agent, or Firm* — Brinks Gilson & Lione

(57) ABSTRACT

The present disclosure provides an engine with an oil supply system including a cam carrier in which a camshaft support hole is formed and in which an oil supply hole is formed to the camshaft support hole; a camshaft in which a camshaft oil line is formed, in which an inlet supplying oil from the cam carrier oil supply hole is formed and in which a first camshaft bifurcated line is formed; first and second cam portions on which cams are formed, of which the camshaft is inserted thereto, of which relative phase angles with respect to the camshaft are variable, disposed corresponding to a first and a second cylinders, and the first and second cam portions in which a cam portion oil line in fluid communication with first camshaft bifurcated line is formed.

15 Claims, 11 Drawing Sheets

(51) Int. Cl.

| | |
|---|---|
| ***F01L 1/356*** | (2006.01) |
| ***F01L 13/00*** | (2006.01) |
| *F02B 75/18* | (2006.01) |
| *F01M 1/06* | (2006.01) |
| *F01L 1/047* | (2006.01) |
| *F01L 1/053* | (2006.01) |

2-CYLINDER HYBRID ENGINE WITH OIL SUPPLY SYSTEM

CROSS-REFERENCE TO RELATED APPLICATION

This application claims priority to and the benefit of Korean Patent Application No. 10-2015-0179486, filed on Dec. 15, 2015, the entire contents of which are incorporated herein by reference.

FIELD

The present disclosure relates to a 2-cylinder engine with an oil supply system. More particularly, the present disclosure relates to a 2-cylinder engine with an oil supply system which includes a continuous variable valve duration apparatus.

BACKGROUND

The statements in this section merely provide background information related to the present disclosure and may not constitute prior art.

Recently, research has been undertaken to enhance fuel efficiency of a vehicle, such as by designing a two cylinder engine or a three cylinder engine.

However, enhancing output and fuel efficiency of the two cylinder engine or the three cylinder engine may be limited according to various vehicle driving conditions.

Also, the two cylinder engine or the three cylinder engine outputs relatively serious vibration, and applying an element, such as a balance shaft, for suppressing vibration to the two cylinder engine or the three cylinder engine may be limiting.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides a 2-cylinder engine with an oil supply system which includes a continuous variable valve duration apparatus which may vary opening duration of a valve according to operation conditions of an engine with a simple construction.

A 2-cylinder engine with an oil supply system according to one form of the present disclosure may include a cam carrier in which a camshaft support hole is formed and in which a cam carrier oil supply hole is formed to the camshaft support hole, a camshaft in which a camshaft oil line is formed along a length direction thereof, in which an inlet supplying oil from the cam carrier oil supply hole is formed, and in which a first camshaft bifurcated line is formed, a first cam portion and a second cam portion on which a first cam and a second cam are formed respectively, in which the camshaft is inserted thereto, of which relative phase angles with respect to the camshaft are variable, the first cam and the second cam disposed corresponding to a first cylinder and a second cylinder respectively, and the first and second cam portions in which a cam portion oil line in fluid communication with the first camshaft bifurcated line is formed, a slider unit transmitting rotation of the camshaft to the first and second cam portions respectively and of which a relative position with respect to the camshaft is variable and a control portion comprising a control shaft on which a control rod is eccentrically formed to control the relative position of the slider unit.

The engine may further include a cam cap mounted to the cam carrier for rotatably supporting the first and second cam portions and in which a cam cap oil line in fluid communication with the cam portion oil line is formed.

A second camshaft bifurcated line bifurcated from the camshaft oil line may be formed in the camshaft, and the engine may further comprise a control shaft supporting portion mounted to the cam carrier for supporting the control shaft and in which a control shaft supporting portion line is formed in fluid communication with the second camshaft bifurcated line.

A control shaft oil line may be formed in the control shaft along a length direction thereof and a first control shaft bifurcated line supplying oil to the slider unit may be bifurcated from the control shaft oil line.

A second control shaft bifurcated line, communicated with the cam cap oil line and bifurcated from the control shaft oil line, may be formed to the control shaft.

A third control shaft bifurcated line in fluid communication with the control shaft supporting portion line and bifurcated from the control shaft oil line may be formed in the control shaft.

The engine may further include a spacer disposed between the control shaft and the control shaft supporting portion and the second camshaft bifurcated line and the third control shaft bifurcated line may supply oil to the spacer.

The slider unit may include a first and second inner brackets transmitting rotation of the camshaft to the first and second cam portions respectively, a slider housing in which the first and the second inner brackets are rotatably inserted, on which a first guiding portion is formed on an upper portion thereof, on which a second guiding portion vertical to or perpendicular to the first guiding portion is formed, and of which a relative position with respect to the camshaft is variable and a guide head on which a head guiding portion slidably connected to the first guiding portion is formed and in which a head hole where the control rod is rotatably insert is formed, wherein the first control shaft bifurcated line may be formed in the control rod, and a head oil line in fluid communication with the first control shaft bifurcated line may be formed in the guide head.

A slider housing line in fluid communication with the head oil line may be formed in the slider housing.

The engine may further include a housing guide on which a guide rail engaged with the second guiding portion is formed and mounted to the cam carrier for guiding movement of the slider housing, wherein the slider housing line may supply the oil supplied from the head oil line to the guide rail.

A cam key may be formed in the first and second cam portions respectively, a first sliding hole and a second sliding hole may be formed in the first and second inner brackets respectively, a cam key pin on which a cam key slot is formed and in which the cam key is slidably inserted, may be rotatably inserted into the first sliding hole in the first and second inner brackets, a camshaft pin may be connected to the camshaft, and a slider pin on which a camshaft pin slot is formed and in which the camshaft pin is slidably inserted therein is formed, may be rotatably inserted into the second sliding hole in the first and second inner brackets.

The engine may further include a slider housing bearing disposed between the slider housing and the first and the second inner brackets respectively.

The engine may further include a partition disposed between the first and the second inner brackets.

The first cam formed to the first cam portion may be a pair of first cams and the second cam formed to the second cam portion may be a pair of second cams, and a cam connecting portion may be formed between each of the pair of first cams and the pair of second cams of each cam portion, and the cam portion oil line may be formed in the cam connecting portion.

A cam key may be formed in the first and second cam portions respectively, a first sliding hole and a second sliding hole may be formed in the first and second inner brackets respectively, a cam key pin on which a cam key slot is formed and in which the cam key is slidably inserted, may be rotatably inserted into the first sliding hole in the first and second inner brackets, and a slider pin may include a pin body and a pin head integrally formed with the pin body, and wherein the pin body may be slidably inserted into the camshaft and the pin head may be rotatably inserted into the second sliding hole of the first and the second inner brackets.

A body oil hole in fluid communication with the camshaft oil line may be formed in the pin body and an oil groove in fluid communication with the body oil hole may be formed in the pin head.

The engine may further include a motor assembly connected to an engine housing and in which a flywheel connected with a crankshaft is rotatably disposed.

As described above, a 2-cylinder engine with an oil supply system according to one form of the present disclosure may effectively supply lubricant oil to a continuous variable valve duration apparatus which may vary opening duration of a valve according to operation conditions of the engine.

Also, the 2-cylinder engine with an oil supply system may be applied to an engine without excessive design change, thus may share considerable elements with a general engine so that productivity may be enhanced and production cost may be reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
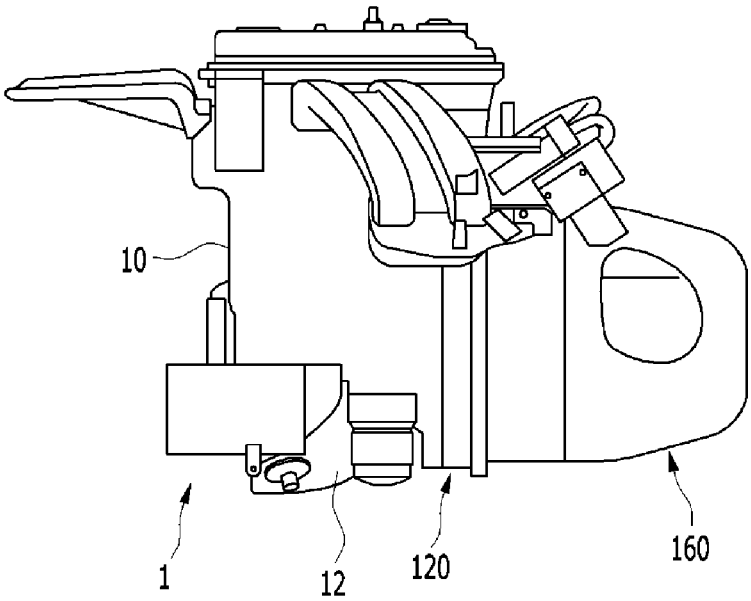
FIG. 1 is a front view of a 2-cylinder engine with an oil supply system according to one form of the present disclosure.

The drawings described herein are for illustration purposes only and are not intended to limit the scope of the present disclosure in any way.

DESCRIPTION OF SYMBOLS

1: engine
10: cylinder head
11: cam carrier
12: engine housing
16: camshaft support hole
18: cam carrier oil supply hole
30: camshaft
32: camshaft hole
34: camshaft oil line
36: inlet
37: first camshaft bifurcated line
38: second camshaft bifurcated line
40: cam cap
46: cam cap oil line
50: guide head
52: head guiding portion
54: head hole
55: head oil line
60: camshaft pin
62: housing guide
64: guide rail
70*a*, 70*b*: first, second cam portion
71, 72: first, second cam
74: cam key
76: cam connecting portion
77: cam portion oil line
80: first inner bracket
81: second inner bracket
82: cam key pin
83: cam key slot
84: slider pin
85: camshaft pin slot
86: first sliding hole
88: second sliding hole
90: slider housing
91: partition
92: slider housing bearing
93: first guiding portion
95: second guiding portion

97: slider housing line
100: control portion
106: control motor
108: control shaft
110: control rod
112: control shaft oil line
113: first control shaft bifurcated line
114: second control shaft bifurcated line
115: third control shaft bifurcated line
120; motor assembly
122: motor housing
124: stator
130: rotor
140: flywheel
150: crankshaft
160: transmission
170: control shaft supporting portion
172: control shaft supporting portion line
180: insert
182: insert pin
190: slider pin
192: pin body
194: pin head
196: body oil hole
198: oil groove
199: communicate hole
200: valve
211, 212: first, second cylinder

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following detailed description, only certain forms of the present disclosure have been shown and described, simply by way of illustration.

As those skilled in the art would realize, the described forms may be modified in various different ways, all without departing from the spirit or scope of the present disclosure A part irrelevant to the description will be omitted to clearly describe the present disclosure, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising," will be understood to imply the inclusion of stated elements but not the exclusion of any other elements.

Figure 2:
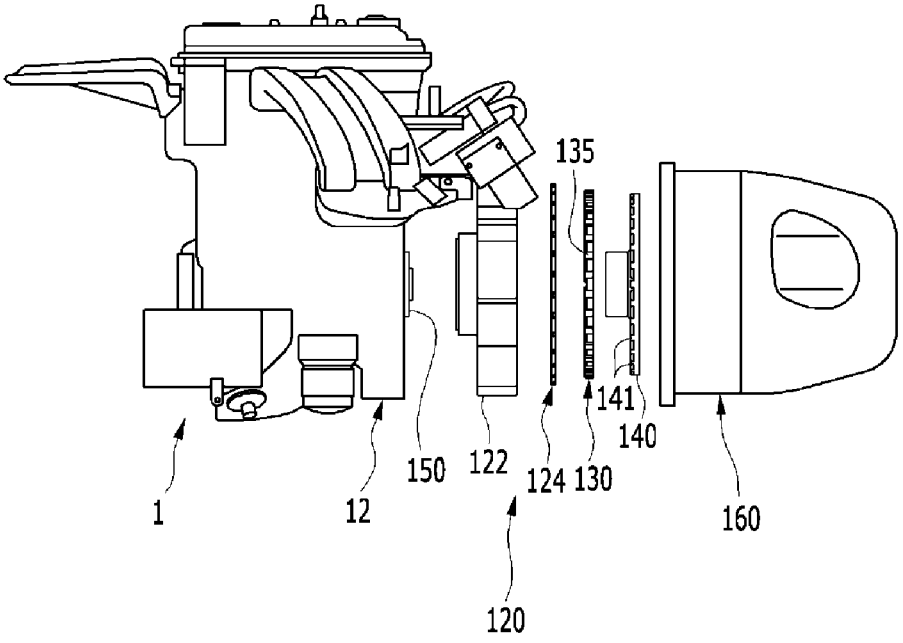
FIG. 2 is an exploded view of a 2-cylinder engine with an oil supply system of the present disclosure.

FIG. 1 is a front view of a 2-cylinder engine with an oil supply system according to one form of the present disclosure and FIG. 2 is an exploded view of a 2-cylinder engine with an oil supply system of the present disclosure.

Figure 3:
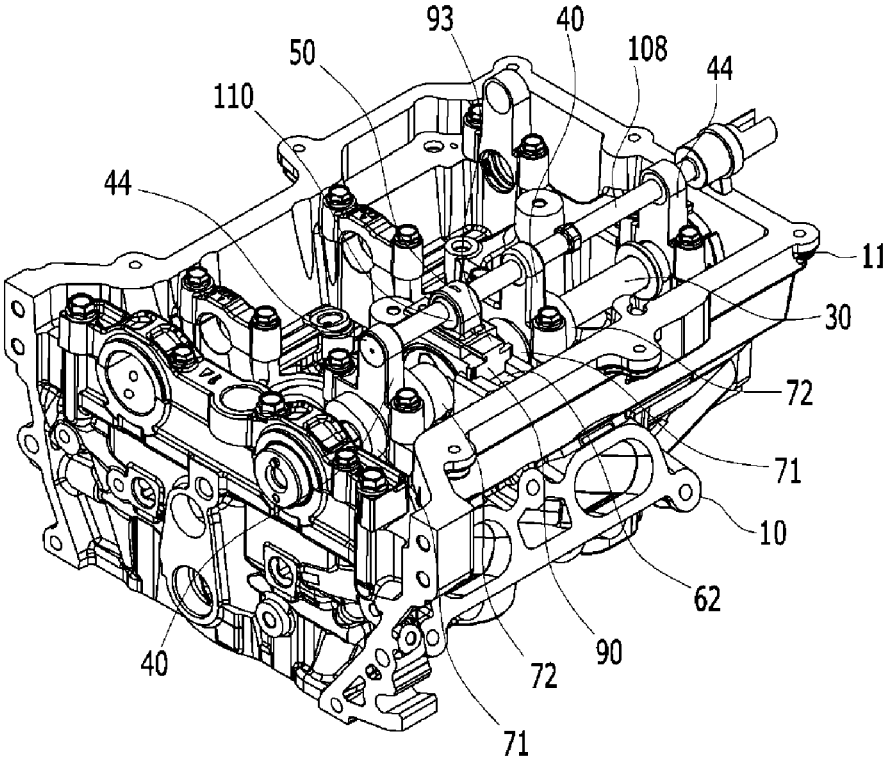
FIG. 3 is a partial exploded perspective view of a 2-cylinder engine with an oil supply system of the present disclosure.
Figure 4:
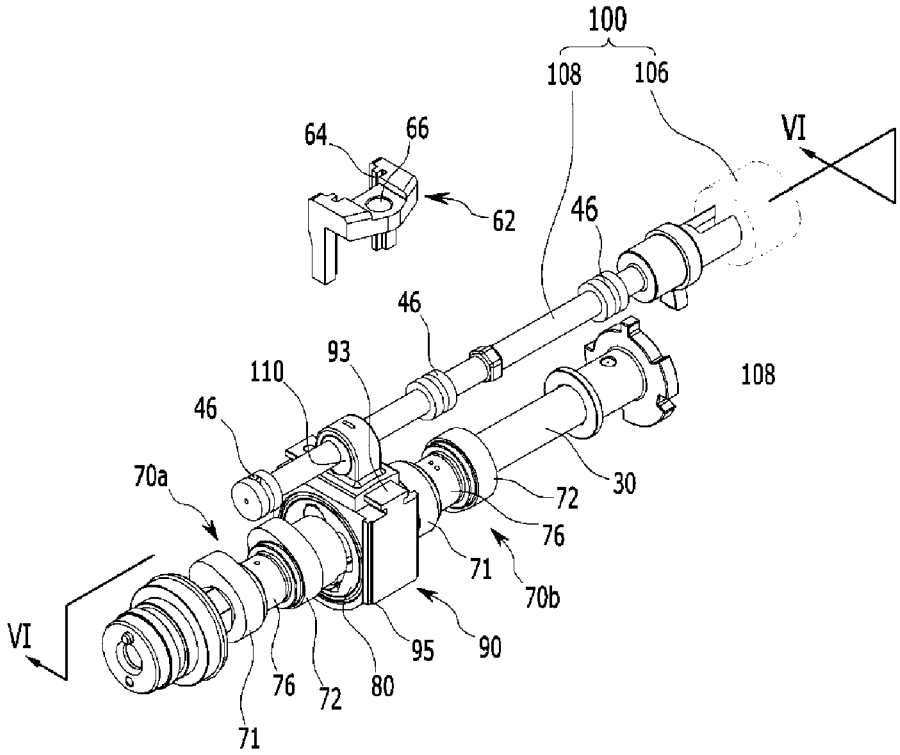
FIG. 4 is a partial perspective view of a continuous variable valve duration apparatus applied to one 2-cylinder engine with an oil supply system of the present disclosure.

FIG. 3 is a partial exploded perspective view of a 2-cylinder engine with an oil supply system of the present disclosure and FIG. 4 is a partial perspective view of a continuous variable valve duration apparatus applied to a 2-cylinder engine with an oil supply system of the present disclosure.

Figure 5:
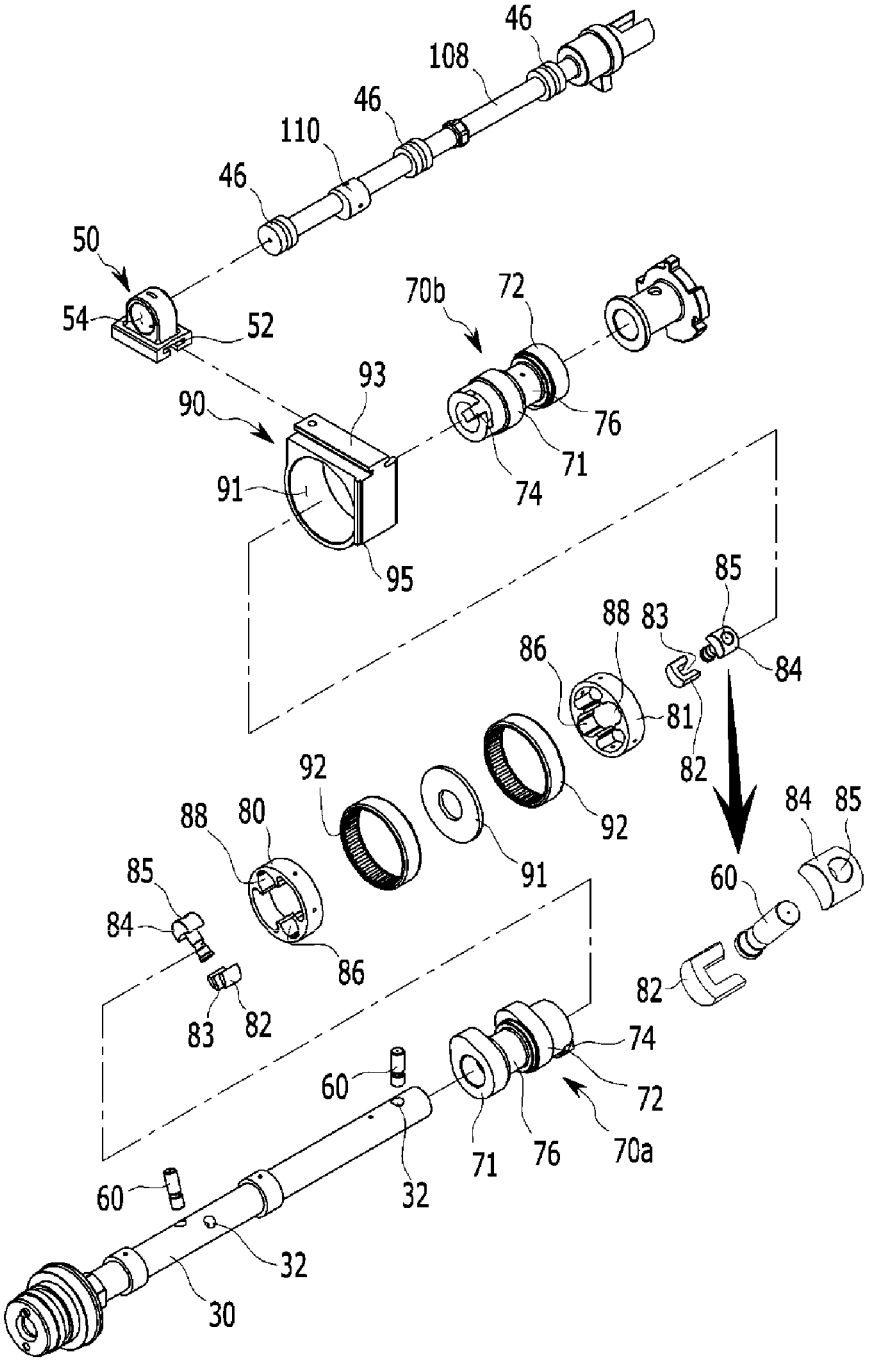
FIG. 5 is a partial exploded perspective view of a continuous variable valve duration apparatus applied to a 2-cylinder engine with an oil supply system of the present disclosure.
Figure 6:
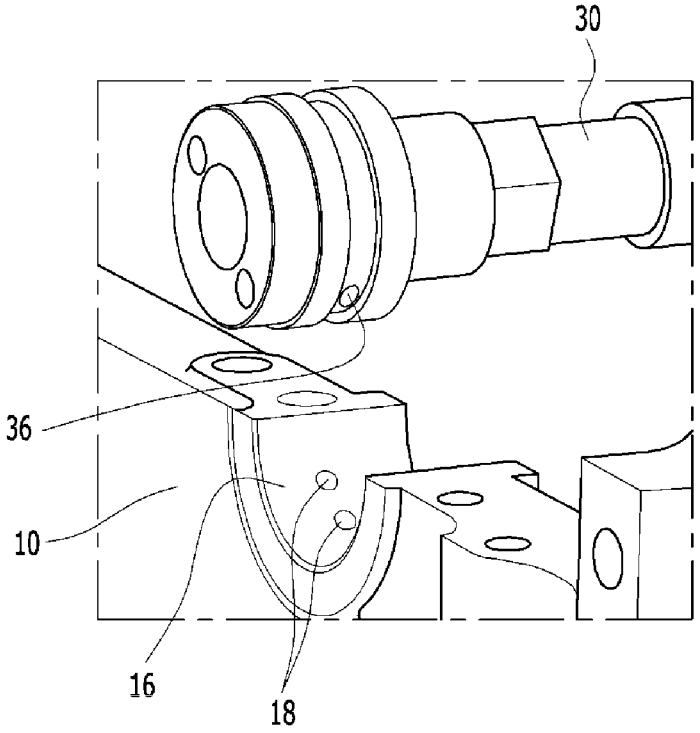
FIG. 6 is a partial perspective view of a 2-cylinder engine with an oil supply system of the present disclosure.

FIG. 5 is a partial exploded perspective view of a continuous variable valve duration apparatus applied to a 2-cylinder engine with an oil supply system of the present disclosure and FIG. 6 is a partial perspective view of a 2-cylinder engine with an oil supply system of the present disclosure.

Figure 7:
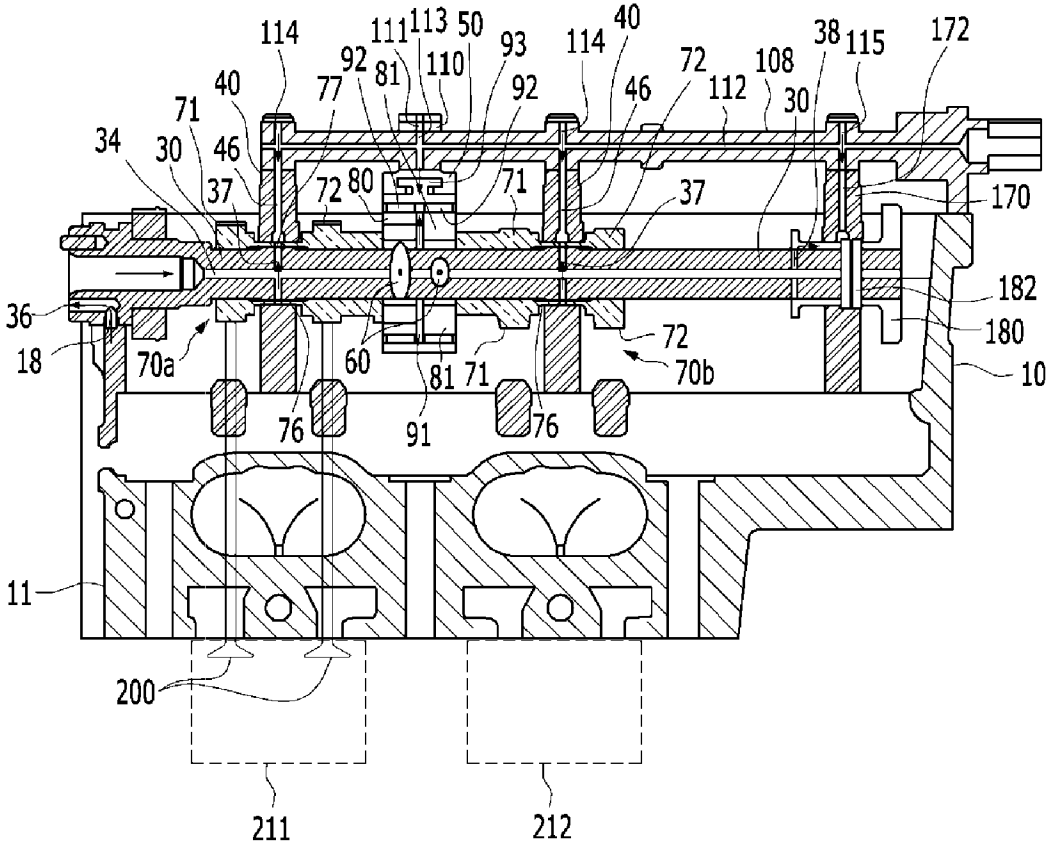
FIG. 7 is a cross-sectional view of a 2-cylinder engine with an oil supply system of the present disclosure.
Figure 8:
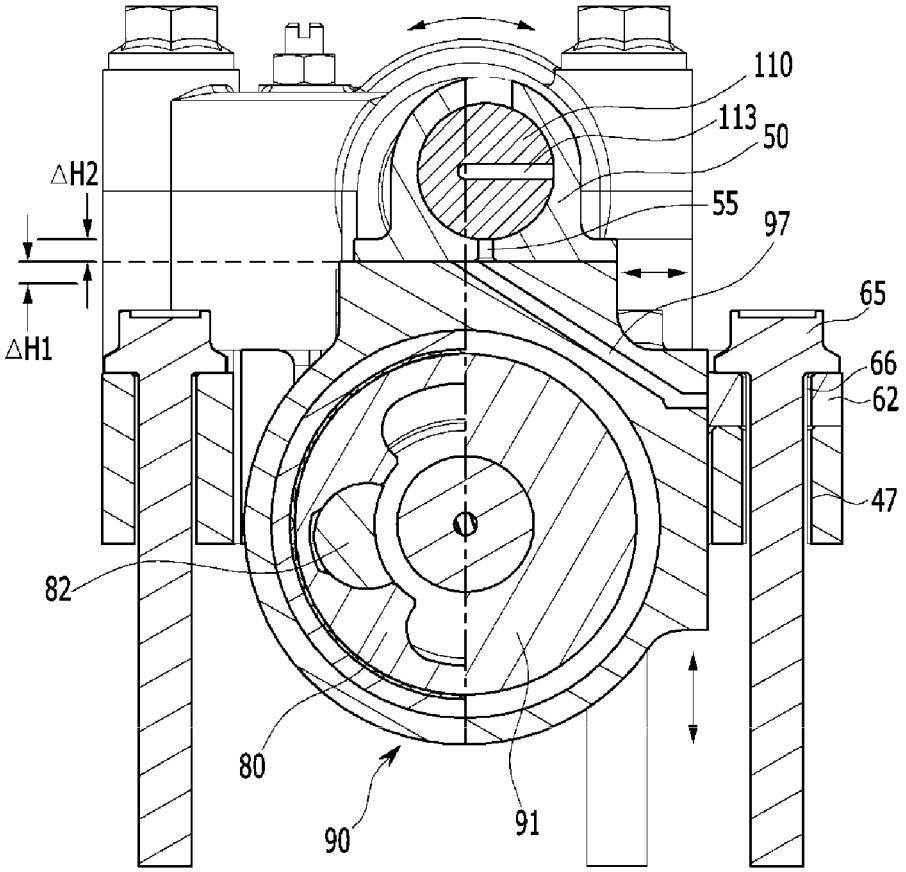
FIG. 8 is a cross-sectional view of a slider housing of a 2-cylinder engine with an oil supply system of the present disclosure.

FIG. 7 is a cross-sectional view of a 2-cylinder engine with an oil supply system of the present disclosure and FIG. 8 is a cross-sectional view of a slider housing of a 2-cylinder engine with an oil supply system of the present disclosure.

Referring to FIG. 1 to FIG. 8, a 2-cylinder engine 1 applied to one form of the present disclosure may include an engine housing 12 connected with a cylinder head 10 to which a cam carrier 11 is mounted, a camshaft 30 mounted to the cam carrier 11, a first cam portion 70*a* on which a cam 71 is formed, in which the camshaft 30 is inserted, of which relative phase angle with respect to the camshaft 30 is variable and disposed to correspond to a first cylinder 211; a second cam portion 70*b* on which a cam 71 is formed, in which the camshaft 30 is inserted, of which relative phase angle with respect to the camshaft 30 is variable and disposed to correspond to a second cylinder 212; a slider unit transmitting rotation of the camshaft 30 to the first and second cam portions 70*a* and 70*b* respectively and of which a relative position with respect to the cam shaft 30 is variable, and a control portion 100 including a control shaft 108 on which a control rod 110 is eccentrically formed and controlling the relative position of the slider unit.

The slider unit includes a first and second inner bracket 80 and 81 transmitting rotation of the camshaft 30 to the first and second cam portions 70*a* and 70*b* respectively; a slider housing 90 in which the first and the second inner brackets 80 and 81 are rotatably inserted, on which a first guiding portion 93 is formed to upper portion thereof, on which a second guiding portion 95 that is vertical or perpendicular to the first guiding portion 93 is formed and of which a relative position with respect to the camshaft 30 is variable; and a guide head 50 on which a head guiding portion 52 slidably connected to the first guiding portion 93 is formed and in which a head hole 54 where the control rod 110 is rotatable insert into is formed.

A housing guide 62 on which a guide rail 64 engaged with the second guiding portion 95 is formed is mounted to the cam carrier 11 for guiding movement of the slider housing 90. The separately formed housing guide 62 is engaged with the cam carrier 11, and thus vibration or noise due to accumulated tolerance of elements may be alleviated or suppressed.

The first guiding portion 93 and the head guiding portion 52 are slidable to each other, the second guiding portion 95 and the guide rail 64 are slidable to each other, and eccentric rotation of the control rod 110 is transferred to a left and right direction movement of the guide head 50 and an up and down direction movement of the slider housing 90. Thus, smooth and precise control of a position of the slider housing 90 may be possible.

A first and second cam 71 and 72 may be formed to the first and the second cam portion 70*a* and 70*b* respectively and a cam connecting portion 76 may be formed between the first and second cams 71 and 72. And a cam cap 40 is connected to the cam carrier 11 for rotatably supporting the control shaft 108.

The first and second cams 71 and 72 rotate to open the valve 200.

A cam key 74 is formed to the first and second cam portions 70*a* and 70*b* respectively and a first sliding hole 86 and a second sliding hole 88 are formed in the first and second inner brackets 80 and 81 respectively.

A cam key pin 82 in which a cam key slot 83 is formed and into which the cam key 74 is slidably inserted, and the cam key pin 82 is rotatably inserted into the each first sliding hole 86.

A camshaft hole 32 is formed to the camshaft 30 and a camshaft pin 60 is inserted into the camshaft hole 32 to be connected to the camshaft 30. And a slider pin 84 in which a camshaft pin slot 85 is formed and into which the camshaft pin 60 is slidably inserted, and the slider pin 84 is rotatably inserted into the each second sliding hole 88.

A slider housing bearing 92 may be disposed between the slider housing 90 and the first and the second inner brackets 80 and 81 respectively, and thus relative rotations between the each slider housing 90 and the first and the second inner brackets 80 and 81 and rigidity may be obtained. The slider housing bearing 92 may be a needle bearing, a ball bearing, a roller bearing and so on.

A partition 91 is disposed in the slider housing 90 between the first and second inner brackets 80 and 81 for preventing the rotations of the first and second inner brackets 80 and 81 from being interrupted.

As shown in FIG. 7, since the slider housing 90 is disposed between the first cam portion 70*a* and the second cam portion 70*b*, the engine layout may be simplified and one slider housing 90 may control rotational speed of the first cam portion 70*a* and the second cam portion 70*b* simultaneously. Thus, the continuous variable valve duration apparatus may be constructed more simply and the number of elements may be reduced.

A control shaft supporting portion 170 is mounted to the cam carrier 11 for supporting the control shaft 108.

A spacer 180 is disposed between the control shaft 108 and the control shaft supporting portion 170.

The 2-cylinder engine with an oil supply system according to one form of the present disclosure may share considerable elements with a four-cylinder engine so that production cost may be reduced.

The spacer 180 may be disposed between the control shaft 108 and the control shaft supporting portion 170 for applying a control shaft and so on which is applied to a general four cylinder engine and to the two cylinder engine which may be applied to the oil supply system according to one form of the present disclosure. The spacer 180 may be positioned to a cam portion which is applied to the general four cylinder engine to support the camshaft 30, and an insert pin 182 may be inserted for fixing the spacer 180 with the camshaft 30.

The engine is a hybrid engine including a motor assembly 120 connected to the engine housing 12 and in which a flywheel 140 connected with a crankshaft 150 is rotatably disposed therein and the motor assembly 120 is connected to a transmission 160.

The motor assembly 120 includes a motor housing 122 connected to the engine housing 12, a stator plate 124 connected to the motor housing 122, and a core plate 130 connected to the stator plate 124 and to which a coil 135 is wound, and magnets 141 corresponding to the coil 135 are connected to the flywheel 140.

Since the stator plate 124 and the core plate 130 are disposed between the flywheel 140 and the motor housing 122, assembly may be easily performed and connection of the stator plate 124 and the core plate 130 may be stable.

The coil 135 and the magnets 141 may be disposed radially, thus the total length of the engine 1, the motor assembly 120, and the transmission 160 may be reduced.

The motor assembly 120 disposed between the engine 1 and the transmission 160 may function as a flywheel and a motor, which may reduce or offset vibration of the engine 1 and assist output of the engine 1 without a balance shaft.

Also, the motor assembly 120 may generate counter torque against the vibration of the engine 1 and reduce the vibration of the engine 1.

Referring to FIG. 6 and FIG. 7, a camshaft support hole 16 is formed to the cam carrier 11 and a cam carrier oil supply hole 18 is formed to the camshaft support hole 16.

A camshaft oil line 34 is formed to the camshaft 30 along a length direction thereof, an inlet 36 supplies oil from the cam carrier oil supply hole 18 to the camshaft 30, and a first camshaft bifurcated line 37 bifurcated from the camshaft oil line 34 is formed to the camshaft 30.

A cam portion oil line 77 in fluid communication with the first camshaft bifurcated line 37 is formed to the first and second cam portions 70*a* and 70*b*. The cam portion oil line 77 is formed to the cam connecting portion 76 thus rotations of the first and second cam portions 70*a* and 70*b* may be easily performed.

A cam cap oil line 46 in fluid communication with the cam portion oil line 77 is formed to the cam cap 40.

A second camshaft bifurcated line 38 bifurcated from the camshaft oil line 34 is formed to the camshaft 30, and a control shaft supporting portion line 172 in fluid communication with the second camshaft bifurcated line 38 is formed to the control shaft supporting portion 170.

A control shaft oil line 112 is formed in the control shaft 108 along a length direction thereof, a first control shaft bifurcated line 113 supplying oil to the slider unit is bifurcated from the control shaft oil line 112.

A second control shaft bifurcated line 114 in fluid communication with the cam cap oil line 46 is bifurcated from the control shaft oil line 112 and is formed in the control shaft 108.

A third control shaft bifurcated line 115 in fluid communication with the control shaft supporting portion line 172 is bifurcated from the control shaft oil line 112 and is formed in the control shaft 108.

The second camshaft bifurcated line 38 and the third control shaft bifurcated line 115 supply oil to the spacer 170.

A head oil line 55 in fluid communication with the first control shaft bifurcated line 113 is formed in the guide head 50.

A slider housing line 97 in fluid communication with the head oil line 55 is formed in the slider housing 90 and the oil from the head oil line 55 is supplied to the first guiding portion 93 and the head guiding portion 52.

The slider housing line 97 supplies oil from the head oil line 55 to the guide rail 46 so that the up and down movement of the slider housing 90 may be easily performed.

Figure 9:
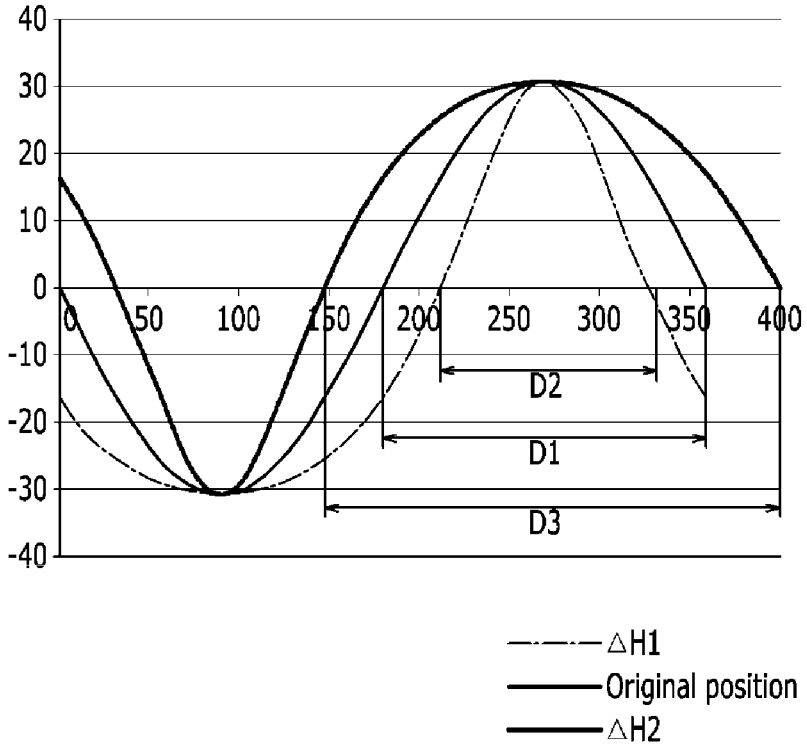
FIG. 9 is a table showing various operations of a continuous variable valve duration apparatus applied to a 2-cylinder engine with an oil supply system of the present disclosure.
Figure 10:
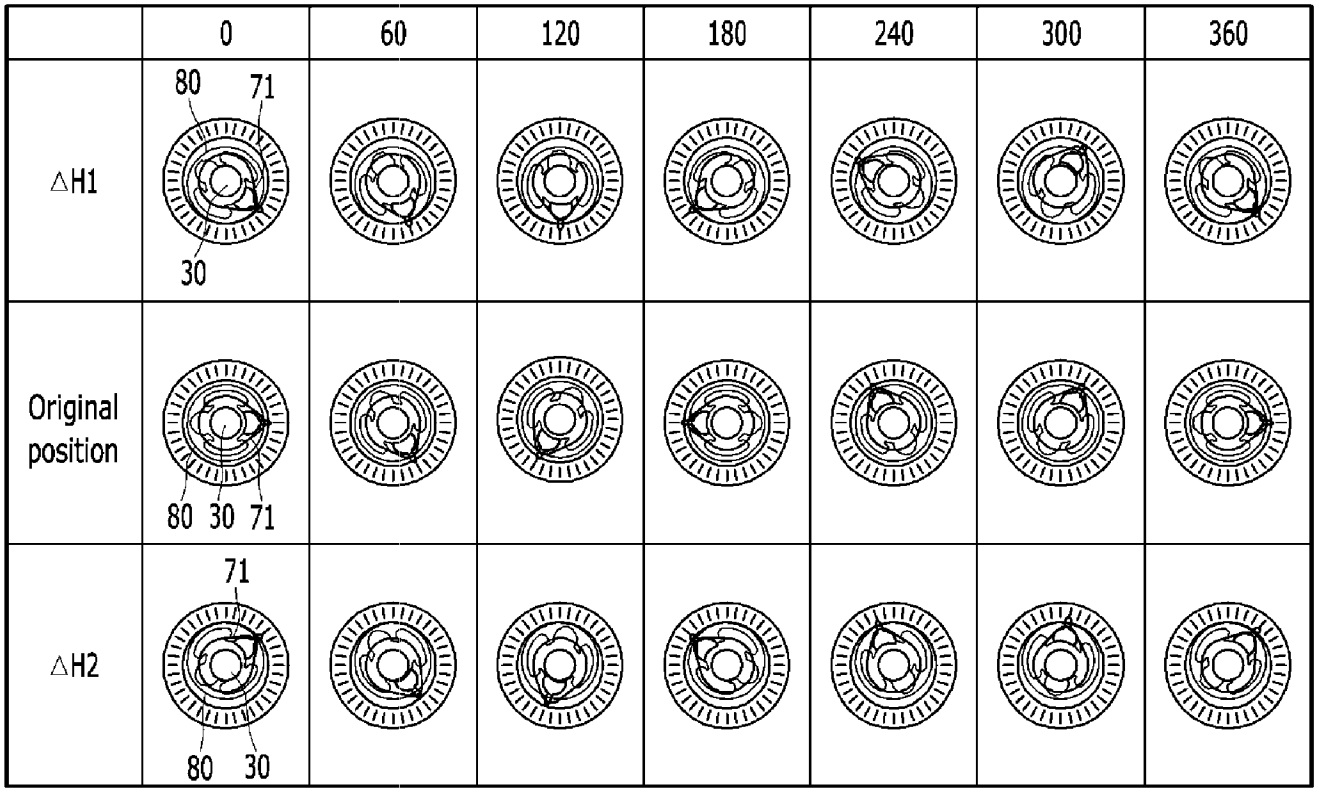
FIG. 10 is a graph showing various operations of a continuous variable valve duration apparatus applied to a 2-cylinder engine with an oil supply system of the present disclosure.

FIG. 9 is a table showing various operations of a continuous variable valve duration apparatus applied to a 2-cylinder engine with an oil supply system of the present disclosure and FIG. 10 is a graph showing various operations of a continuous variable valve duration apparatus applied to a 2-cylinder engine with an oil supply system of the present disclosure.

Referring to FIG. 1 to FIG. 10, operations of the 2-cylinder engine applied to one form of the present disclosure will be described.

When rotation centers of the camshaft 30 and the first and second inner brackets 80 and 81 are coincident, that is, the slider housing 90 is positioned at an original position as shown in FIG. 9, the cams 71 and 72 rotate with the same phase angle of the camshaft 30. That is, the cams 71 and 72 and the camshaft 30 rotate with the same speed.

According to engine operation states, an ECU (engine control unit or electric control unit) transmits control signals to the control motor 106 of the control portion 100 to rotate the control shaft 108. Then, the control rod 110 eccentrically formed to the control shaft 108 rotates and the rotation of the control rod 110 is transferred to a left and right direction movement of the guide head 50 and an up and down direction movement of the slider housing 90.

According to the rotation of the control shaft 108, the positions of the slider housing 90 and the first and the second inner brackets 80 and 81 with respect to a rotation center of the camshaft 30 are changed upward or downward.

When, the position of the slider housing 90 with respect to the camshaft 30 is changed, the relative rotation speed of the cams 71 and 72 with respect to the rotation speed of the camshaft 30 are changed.

While the camshaft pin 60 is rotated together with the camshaft 30, the camshaft pin 60 is slidable within the camshaft pin slot 85, the slider pin 84 is rotatably inserted into the second sliding hole 88, the cam key pin 82 is rotatably inserted into the first sliding hole 82, and the cam key 74 is slidable within the cam key slot 83. Thus the relative rotation speed of the cams 71 and 72 with respect to the rotation speed of the camshaft 30 is changed.

As shown in FIG. 8, while the phase angle of the camshaft 30 is constantly changed when the relative position of the slider housing 90 with respect to the rotation center of the camshaft 30 is changed downward as ΔH1, as shown in FIG. 9, the rotation speed of the cams 71 and 72 is relatively slower than rotation speed of the camshaft 30 near approximately 60 to 120 degrees, then the rotation speed of the cams 71 and 72 is relatively faster than the rotation speed of the camshaft 30 near approximately 240 to 300 degrees.

As shown in FIG. 8, while the phase angle of the camshaft 30 is constantly changed when the relative position of the slider housing 90 with respect to the rotation center of the camshaft 30 is changed upward as ΔH2, as shown in FIG. 9, the rotation speed of the cams 71 and 72 is relatively faster than the rotation speed of the camshaft 30 near approximately 60 to 120 degrees, then the rotation speed of the cams 71 and 72 is relatively slower than rotation speed of the camshaft 30 near approximately 240 to 300 degrees.

That is, as shown in FIG. 10, valve duration D2 in the case that the relative position of the slider housing 90 is changed to ΔH1 is shorter than valve duration D1 in the case that the position of the slider housing 90 is at the original position.

Also, valve duration D3 in the case that the relative position of the slider housing 90 is changed to ΔH2 is longer than valve duration D1 in the case that the position of the slider housing 90 is at the original position.

In FIG. 10, for better comprehension and ease of description, peak points in FIG. 10 are constant, but it is not limited thereto.

According to adjusting contacting positions of the valve 200 and the cams 71 and 72, contacting angles of the valve 200 and the cams 71 and 72, a position of the cam key 74 and so on, valve duration may be enlarged by advancing opening timing and retarding closing timing of the valve 200. Or, valve duration may be shortened by retarding opening timing and advancing closing timing of the valve 200.

Also, opening timing of the valve 200 may be constant and closing timing of the valve 200 may be retarded or advanced as requested.

Also, closing timing of the valve 200 may be constant and opening timing of the valve 200 may be retarded or advanced as requested.

Figure 11:
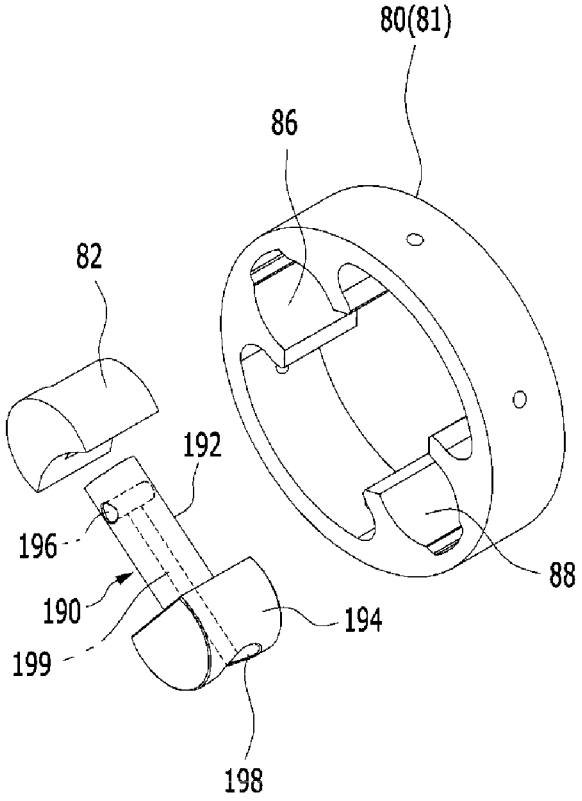
FIG. 11 is a drawing showing a slider pin applied to a 2-cylinder engine with an oil supply system of the present disclosure.

FIG. 11 is a drawing showing a slider pin applied to a 2-cylinder engine with an oil supply system of the present disclosure. In one form, the camshaft pin and the slider pin are disconnected, however a slider pin 190 as shown in FIG. 11 includes a pin body 192 slidably inserted into the camshaft hole 32 of camshaft 30 and a pin head 194 integrally formed with the pin body 192 and rotatably inserted into the second sliding hole 88. A body oil hole 196 in fluid communication with the camshaft oil line 34 is formed to the pin body 192. And an oil groove 198 in fluid communication with the body oil hole 196 is formed to the pin head 194 through a communicating hole 199

Since lubricant oil may be supplied from the camshaft oil line 34 to the oil groove 198 through the body oil hole 196 and the communicating hole 199, friction between the pin head 194 and the second sliding hole 88 may be reduced. Except the slider pin, operations and structures of the powertrain according to a modified form of the present disclosure are the same of the forms described above, repeated description will be omitted.

As described above, the 2-cylinder engine with an oil supply system according to various forms of the present disclosure may perform various valve durations according to operation conditions of an engine to enhance fuel efficiency and increase output. Also, the 2-cylinder engine with an oil supply system according to forms of the present disclosure may suppress vibration and reduce engine size by applying the motor assembly.

Also, since the 2-cylinder engine with an oil supply system according to various forms of the present disclosure may supply oil through the camshaft and the control shaft, oil supply may be easily performed to enhance durability of the engine.

While this disclosure has been described in connection with what is presently considered to be practical forms, it is to be understood that the disclosure is not limited to the disclosed forms. On the contrary, it is intended to cover various modifications and equivalent arrangements included within the spirit and scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A 2-cylinder engine with an oil supply system comprising:

a cam carrier in which a camshaft support hole is formed and in which a cam carrier oil supply hole is formed to communicate with the camshaft support hole;

a camshaft in which a camshaft oil line is formed along a length direction thereof, in which an inlet supplying oil from the cam carrier oil supply hole is formed, and in which a first camshaft bifurcated line is formed;

a first cam portion and a second cam portion on which a first cam and a second cam are formed, respectively, into which the camshaft is inserted, of which a relative phase angle with respect to the camshaft is variable, the first cam and the second cam disposed corresponding to a first cylinder and a second cylinder, respectively, and the first and second cam portions in which a cam portion oil line in fluid communication with the first camshaft bifurcated line is formed;

a slider unit transmitting rotation of the camshaft to the first and second cam portions respectively and of which a relative position with respect to the camshaft is variable; and a control portion comprising a control shaft on which a control rod is eccentrically formed to control the relative position of the slider unit, wherein the engine further comprises a cam cap mounted to the cam carrier for rotatably supporting the first and second cam portions and in which a cam cap oil line in fluid communication with the cam portion oil line is formed, wherein a second camshaft bifurcated line bifurcated from the camshaft oil line is formed in the camshaft, and wherein the engine further comprises a control shaft supporting portion mounted to the cam carrier for supporting the control shaft and in which a control shaft supporting portion line is formed in fluid communication with the second camshaft bifurcated line.

2. The 2-cylinder engine with an oil supply system of claim 1, wherein:

a control shaft oil line is formed in the control shaft along a length direction thereof; and a first control shaft bifurcated line supplying oil to the slider unit is bifurcated from the control shaft oil line.

3. The 2-cylinder engine with an oil supply system of claim 2, wherein a second control shaft bifurcated line in fluid communication with the cam cap oil line and bifurcated from the control shaft oil line is formed in the control shaft.

4. The 2-cylinder engine with an oil supply system of claim 2, wherein a third control shaft bifurcated line in fluid communication with the control shaft supporting portion line and bifurcated from the control shaft oil line is formed in the control shaft.

5. The 2-cylinder engine with an oil supply system of claim 4, wherein;

the engine further comprises a spacer disposed between the control shaft and the control shaft supporting portion; and the second camshaft bifurcated line and the third control shaft bifurcated line supply oil to the spacer.

6. The 2-cylinder engine with an oil supply system of claim 2, wherein the slider unit comprises:

a first inner bracket and a second inner bracket transmitting rotation of the camshaft to the first and second cam portions respectively;

a slider housing in which the first and the second inner brackets are rotatably inserted, on which a first guiding portion is formed on an upper portion thereof, on which a second guiding portion perpendicular to the first guiding portion is formed, and of which a relative position with respect to the camshaft is variable; and a guide head on which a head guiding portion slidably connected to the first guiding portion is formed and in which a head hole where the control rod is rotatably insert is formed;

wherein the first control shaft bifurcated line is formed in the control rod, and a head oil line in fluid communication with the first control shaft bifurcated line is formed in the guide head.

7. The 2-cylinder engine with an oil supply system of claim 6, wherein a slider housing line in fluid communication with the head oil line is formed in the slider housing.

8. The 2-cylinder engine with an oil supply system of claim 7, wherein the engine further comprises a housing guide on which a guide rail engaged with the second guiding portion is formed and mounted to the cam carrier for guiding movement of the slider housing, wherein the slider housing line supplies oil supplied from the head oil line to the guide rail.

9. The 2-cylinder engine with an oil supply system of claim 6, wherein:

a cam key is formed in the first and second cam portions respectively;

a first sliding hole and a second sliding hole are formed in the first and second inner brackets respectively;

a cam key pin on which a cam key slot is formed and in which the cam key is slidably inserted, is rotatably inserted into the first sliding hole in the first and second inner brackets;

a camshaft pin is connected to the camshaft; and a slider pin on which a camshaft pin slot is formed and in which the camshaft pin is slidably inserted therein, is rotatably inserted into the second sliding hole in the first and second inner brackets.

10. The 2-cylinder engine with an oil supply system of claim 9, wherein the engine further comprises a slider housing bearing disposed between the slider housing and the first and the second inner brackets respectively.

11. The 2-cylinder engine with an oil supply system of claim 10, wherein the engine further comprises a partition disposed between the first and the second inner brackets.

12. The 2-cylinder engine with an oil supply system of claim 1, wherein:

the first cam formed to the first cam portion is a pair of first cams and the second cam formed to the second cam portion is a pair of second cams; and a cam connecting portion is formed between each of the pair of first cams and the pair of second cams of each cam portion; and the cam portion oil line is formed in the cam connecting portions.

13. The 2-cylinder engine with an oil supply system of claim 6, wherein:

a cam key is formed in the first and second cam portions respectively;

a first sliding hole and a second sliding hole are formed in the first and second inner brackets respectively;

a cam key pin on which a cam key slot is formed and in which the cam key is slidably inserted, is rotatably inserted into the first sliding hole in the first and second inner brackets; and a slider pin including a pin body and a pin head integrally formed with the pin body, and wherein the pin body is slidably inserted into the camshaft and the pin head is rotatably inserted into the second sliding hole of the first and the second inner brackets.

14. The 2-cylinder engine with an oil supply system of claim 13, wherein:

a body oil hole in fluid communication with the camshaft oil line is formed in the pin body; and an oil groove in fluid communication with the body oil hole is formed in the pin head.

15. The 2-cylinder engine with an oil supply system of claim 1, wherein the engine further comprises a motor assembly connected to an engine housing and in which a flywheel connected with a crankshaft is rotatably disposed.

* * * * *